US007068224B2

(12) United States Patent
Carrender et al.

(10) Patent No.: US 7,068,224 B2
(45) Date of Patent: Jun. 27, 2006

(54) SWITCHING PATCH ANTENNA

(75) Inventors: Curt Carrender, Morgan Hill, CA (US); Paul S. Drzaic, Morgan Hill, CA (US); Robert Martin, San Jose, CA (US); Gregory P. Katterhagen, Gilroy, CA (US); John M. Price, Morgan Hill, CA (US)

(73) Assignee: Alien Technology Corporation, Morgan Hill, CA (US)

( * ) Notice: Subject to any disclaimer, the term of this patent is extended or adjusted under 35 U.S.C. 154(b) by 0 days.

(21) Appl. No.: 10/800,164

(22) Filed: Mar. 12, 2004

(65) Prior Publication Data

US 2005/0200528 A1 Sep. 15, 2005

(51) Int. Cl.
*H01Q 1/38* (2006.01)

(52) U.S. Cl. ..... 343/700 MS; 343/846

(58) Field of Classification Search ..... 343/700 MS, 343/846, 848, 850, 853, 702; 340/10.32
See application file for complete search history.

(56) References Cited

U.S. PATENT DOCUMENTS 4,538,153 A * 8/1985 Taga ..... 343/700 MS
4,903,033 A * 2/1990 Tsao et al. ..... 343/700 MS
5,241,321 A * 8/1993 Tsao ..... 343/700 MS
5,300,936 A * 4/1994 Izadian ..... 343/700 MS
6,486,769 B1 11/2002 McLean ..... 340/10.32
2005/0057396 A1* 3/2005 Boyanov ..... 343/700 MS

OTHER PUBLICATIONS

J.F. Zurcher and F.E. Gardiol, "Broadband Patch Antennas", XP002327945, Artech House, Inc., pp. 124-129 (1995).
S. K. Padhi, et al., "A Dual Polarized Aperture Coupled Microstrip Patch Antenna With High Isolation for RFID Applications", XP010564017, IEEE Antennas and Propagation Society International Symposium. 2001 Digest, pp. 2-5 (Jul. 8-13, 2001).
Naftali Herscovici, "New Considerations in the Design of Microstrip Antennas," XP-000766091, IEEE on Antennas and Propagation, vol. 46, No. 6, pp. 807-812 (Jun. 1998).
PCT Invitation to Pay Additional Fees for PCT Counterpart Application No. PCT/US2005/004923 Containing International Search Report, 7 pgs. (Jun. 2, 2005).

(Continued)

*Primary Examiner*—Hoang V. Nguyen
(74) *Attorney, Agent, or Firm*—Blakely, Sokoloff, Taylor & Zafman LLP

(57) ABSTRACT

According to an embodiment of the invention, a patch antenna includes a patch coupled to a ground plane. The ground plane includes a first and second strip line. When the first strip line is activated, the antenna generates a signal having a first polarization, and when the second strip line is activated, the antenna generates a second polarization. The first polarization may be a horizontal polarization, and the second polarization may be a vertical polarization. The antenna may be incorporated into a radio frequency identification (RFID) interrogator, which may be used to read RFID tags attached to individual items.

17 Claims, 6 Drawing Sheets

OTHER PUBLICATIONS

PCT Notification Of Transmittal Of The International Search Report And The Written Opinion Of The International Searching Authority, Or The Declaration, for PCT International Appln No. US2005/004923, mailed Aug. 2, 2005 (15 pages total).

* cited by examiner

SWITCHING PATCH ANTENNA

FIELD OF THE INVENTION

The invention relates to antennas generally, and specifically to a polarizing antenna for a radio frequency identification system.

BACKGROUND

Goods and other items can be tracked and identified using a radio frequency identification (RFID) system. The RFID system includes an RFID tag, which is placed on the item to be tracked. The RFID tag is a small transponder that can be read by an RFID interrogator. The interrogator includes a transceiver and an antenna. The antenna emits electromagnetic (EM) waves generated by the transceiver, which, when received by the tag, activate the tag. Once the tag has been activated, the tag can modify and reflect the waves back to the interrogator, thereby identifying the item to which the tag is attached or is otherwise associated with.

The interrogator may be a hand held or stationary device that transmits a radio signal which may be intercepted by the tag. When the tag passes through the radio waves, the tag detects the signal and is activated. Data encoded in the tag can then be transmitted to the interrogator for further processing. This system allows for quick and easy identification for a large number of items by simply passing them through the scope of an interrogator. This system will also identify items on which tag is not exposed, such as items in which the tag is located internally. Further, the interrogator can read multiple tags very quickly, such as items passing by the interrogator while the items are on a conveyer belt.

There are three basic types of RFID tags. A beam-powered tag is a passive device which receives energy required for operation from the radio waves generated by the interrogator. The beam powered tag rectifies an EM field and creates a change in reflectivity of the field which is reflected to and read by the interrogator. A battery-powered tag still receives and reflects EM waves from the interrogator, however the battery powered tag includes a battery to power the tag. An active tag actively transmits EM waves which are then received by the interrogator.

A typical interrogator may have a range of less than 10 meters, but the range can extend to more than 200 meters. The strength of the signal transmitted by the interrogator is one factor determining its range. Another is the tag's alignment with the axis of polarization of the transmitted signal. One way to improve the range of the interrogator is to have the antenna on the tag aligned with the axis of polarization of the antenna on the interrogator. For example, a conveyer belt may send a number of similar or identical boxes past an interrogator, and the RFID tags in the boxes can be aligned with the axis of polarization of the antenna on the interrogator. As a further example, the antenna on the tag may be placed horizontally along the inside of the box, and the interrogator may transmit along that horizontal plane.

In the above-mentioned example, it is previously known what the orientation of the items, and therefore the tags, will be. A common type of interrogator includes an antenna that transmits a signal that is predominantly linearly polarized, with this polarization oriented in a single direction. A tag will have an optimum orientation of its antenna to this polarized signal. If a tag happens to be positioned with its antenna at a ninety-degree angle relative to this optimum orientation, the communication range might only be one-twentieth the range of a properly aligned tag. As a result, when the orientation of items passing the interrogator is not known, the tags that are not aligned with the polarization of the interrogator may not be read. Some interrogators include an antenna that transmits a circularly polarized signal. However, to generate this circularly polarized signal, the strength of the outputted EM wave is significantly reduced. Other interrogators include two antennas; one to transmit horizontally polarized signals, and another to transmit vertically polarized signals. However adding the second antenna not only increases the complexity and cost of the interrogator, but also the size. What is needed is a simple and compact interrogator for reading RFID tags of differing orientations.

SUMMARY OF THE DESCRIPTION

According to an embodiment of the invention, a patch antenna includes a patch coupled to a ground plane. The ground plane includes a first and second strip line. When the first strip line is activated, the antenna generates a signal having a first polarization, and when the second strip line is activated, the antenna generates a second polarization. The first polarization may be a horizontal polarization, and the second polarization may be a vertical polarization. The antenna may be incorporated into a radio frequency identification (RFID) interrogator, which may be used to read RFID tags attached to or otherwise associated with individual items.

BRIEF DESCRIPTION OF THE DRAWINGS

One or more embodiments of the present invention are illustrated by way of example and not limitation in the figures of the accompanying drawings, in which like references indicate similar elements and in which.

DETAILED DESCRIPTION

Figure 1:
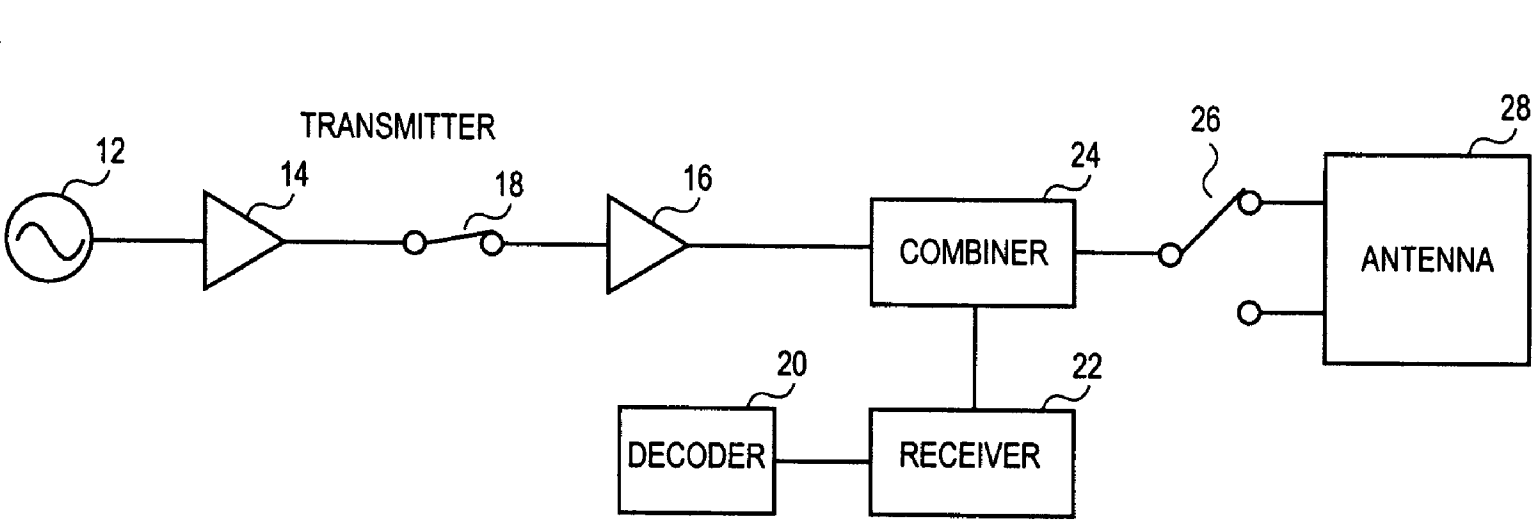
FIG. 1 illustrates an interrogator according to an embodiment of the invention.

Described herein is a switching antenna which may be a patch antenna. Note that in this description, references to "one embodiment" or "an embodiment" mean that the feature being referred to is included in at least one embodiment of the present invention. Further, separate references to "one embodiment" or "an embodiment" in this description do not necessarily refer to the same embodiment; however, such embodiments are also not mutually exclusive unless so stated, and except as will be readily apparent to those skilled in the art from the description. For example, a feature, structure, act, etc. described in one embodiment may also be included in other embodiments. Thus, the present invention can include a variety of combinations and/or integrations of the embodiments described herein.

According to an embodiment of the invention, a radio frequency identification (RFID) interrogator includes an antenna capable of alternately transmitting horizontal and vertically polarized radio waves. The antenna may be a patch antenna, which includes a patch suspended above a ground plane. The ground plane includes a first strip line and a second strip line. The first strip line may be oriented such that when it is activated, the antenna assembly transmits a horizontally polarized signal. The second strip line may be oriented such that when it is activated, the antenna transmits a vertically polarized signal. Here, the reference to "horizontal" and "vertical" simply means that the signals are oriented at a polarization angle equal to, or nearly equal to, ninety degrees relative to each other; the signals can be oriented at any number of angles relative to the earth. According to a first embodiment of the invention, the ground plane includes an aperture. The aperture may be cross-shaped. The aperture in the ground plane allows the patch to be suspended above the ground plane without any electrical connection between the two, and to generate an electric field between the ground plane and the patch. According to a second embodiment of the invention, the first strip line is coupled to an edge of the patch, and the second strip line is coupled to another edge of the patch. According to a third and fourth embodiment of the invention, the first and second strip lines are coupled to an interior area on the patch, and may be located along either a cross pattern across the patch or along the diagonal of the patch.

These various antennas may be included in an RFID interrogator. The RFID interrogator can alternately activate the first and second strip lines to switch between horizontal and vertical polarization. Each strip line is separately activated so that the interrogator is transmitting either a horizontally or a vertically polarized signal at any given time. The interrogator can rapidly switch between the polarizations until a return signal is received from an RFID tag. The interrogator can then determine the identity of the interrogated tag. In this way, an RFID interrogator can read RFID tags located within packages or other items that are horizontally or vertically aligned with the orientation of the interrogator.

FIG. 1 illustrates an interrogator 10 according to an embodiment of the invention. FIG. 1 shows a block diagram of the functional elements of an interrogator 10. The interrogator may include a wave generator 12, two amplifiers 14 and 16, a switch 18, a decoder 20, a receiver 22, a combiner 24, an antenna switch 26, and an antenna 28. The antenna 28 will be described in several embodiments below. The switch 26 is capable of switching between two inputs to the antenna 28, which alternately generate a horizontally polarized and a vertically polarized radio wave. For example, when the switch 26 is in the top position, the antenna 28 may transmit a horizontally polarized wave, and when the switch 26 is in the lower position, the antenna 28 may transmit a vertically polarized wave. According to the several embodiments described below, the antenna 28 is a patch antenna.

The decoder 20 decodes the incoming signals received from the RFID tags to determine the identity of the items to which they are attached as well as switching between the two directions of polarization. The receiver 22 receives the incoming data transmitted by the tag and forwards it to the decoder 22. The wave generator, two amplifiers 14 and 16, and the switch 18 comprise a transmitter, which generates outgoing waves to search for RFID tags. The combiner 24 switches between transmitting and receiving modes.

Since the antenna 28 is transmitting only along one axis of polarization at a time, the full strength of the transmitted signal is directed along that one axis. In this way, everything else being equal, each signal has a greater range than a comparable circularly polarized signal. As a result, the antenna 28 is capable of transmitting longer-range signals along two axes of polarization without increasing the power output of the interrogator 10. Further, a second antenna is not required to transmit signals along a second axis of polarization.

Figure 2A:
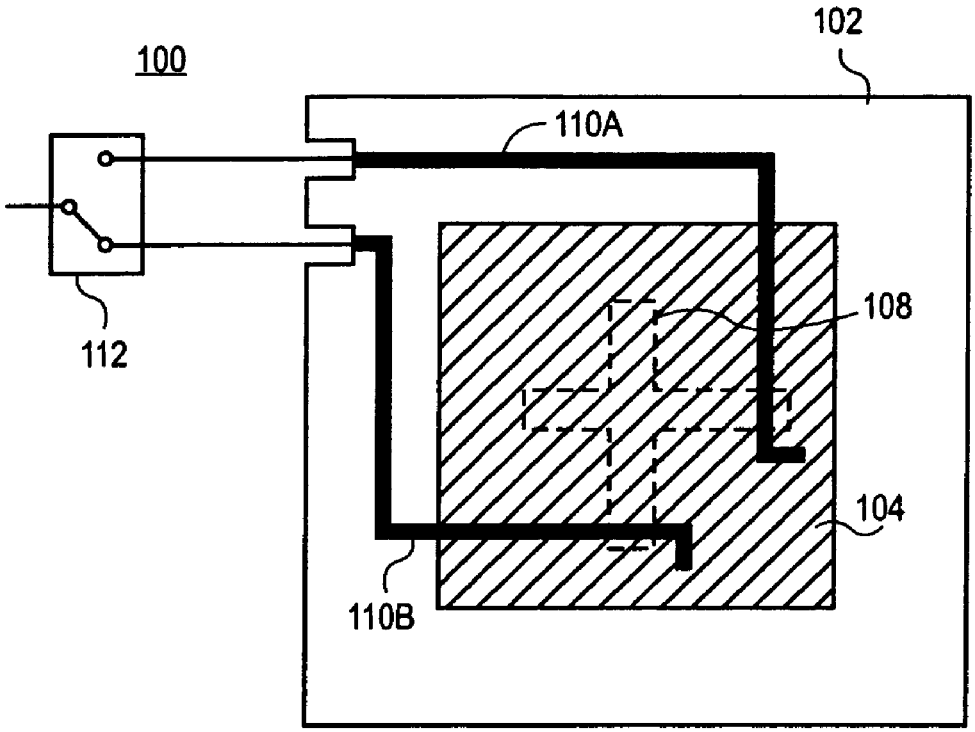
FIGS. 2A and 2B illustrate an aperture patch antenna according to a first embodiment of the invention.
Figure 2B:
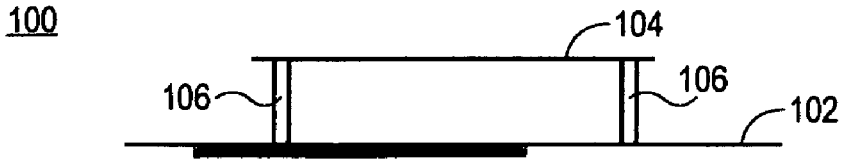

FIGS. 2A and 2B illustrate an aperture patch antenna according to a first embodiment of the invention. The aperture patch antenna may be the antenna 28 described above. The aperture patch antenna 100 includes a ground plane 102 and a patch 104. The patch 104 is suspended above the ground plane 102, as can be seen in the cross sectional view in FIG. 2B. According to this embodiment, the ground plane 102 and patch 104 are physically connected through an insulator such as a plastic support 106. The ground plane 102 includes an aperture 108 formed in it. The aperture 108 creates an electric field when either of the strip lines 110*a* and 100*b* is activated. The electric field propagates a wave, which is transmitted by the patch 104. The aperture 108, as shown here, is in the shape of a cross. It is understood that other aperture shapes may be used according to the needs of the application.

The two strip lines 110*a* and 110*b* may be activated to propagate either a horizontally or a vertically polarized wave. Depending on the orientation of the antenna 100, when the strip line 110*a* is activated, the output of the patch 104 may be a horizontally polarized wave, and when the strip line 110*b* is activated, the output of the patch 104 may be a vertically polarized wave. The strip lines 110 may be alternately activated using a switch 112. The switch 112 may be the switch 26 shown above. When the interrogator is searching for RFID tags, the switch 112 may rapidly alternate between activating the strip lines 110*a* and 110*b*. By doing this, the interrogator 10 will alternately transmit horizontally and vertically polarized signals, which can be used to identify items, such as items in boxes that are typically alternately horizontally or vertically placed. For example, if a conveyer belt moves several items past a fixed interrogator, the interrogator will be able to read tags that are both horizontally and vertically oriented.

According to an embodiment of the invention, the ground plane 102 has a nominal side length of 6.5 inches, and the length may range between 1 inch and 18 inches, depending on application. The patch may have a nominal side length of 4.25 inches, the length ranging between 0.5 inches and 12 inches. The width of the strip lines 110*a* and 110*b* may nominally be 0.1875 inches, ranging between 0.03125 inches and 1 inch. The separation between the ground plane 102 and the patch 104 is nominally 0.5625 inches, ranging between 0.25 inches and 5 inches. Each arm of the aperture 108 may be nominally 0.25 inches wide and 3.25 inches long. These dimensions may be used to create the antenna 28 to be used with the RFID interrogator 10, according to one embodiment of the invention.

According to one embodiment of the invention, the space between the ground plane 102 and the patch 104 may be left empty (filled with air), or filled with a dielectric material. The dielectric material may have a dielectric constant ($\in_r$) of between 1 and 12. For example, air has an $\in_r \sim 1$. An example of a dielectric that may be used is the RO4003C™ dielectric by Rogers Corporation of Rogers, Conn., having an $\in_r = 3.38$. The specific dielectric material may be chosen based on the requirements of the interrogator.

FIGS. 3, 4 and 5 collectively illustrate several alternate embodiments of the present invention. Any of these alternate antennas may be used with the previously described interrogator 10, depending on the requirements of the system. For example, different embodiments may exhibit frequency characteristics, and may exhibit greater signal strength at a different frequency. Other embodiments may be chosen for their size, ease of manufacture, etc. However, each of these alternative embodiments is capable of transmitting both horizontally and vertically polarized signals using a single compact patch antenna, thereby reducing the complexity and size of an interrogator while still being able to read tags oriented along two axes. Further, the specific dimensions and materials mentioned above regarding the patch antenna 100 may also apply to the antennas described in FIGS. 3, 4 and 5.

Figure 3A:
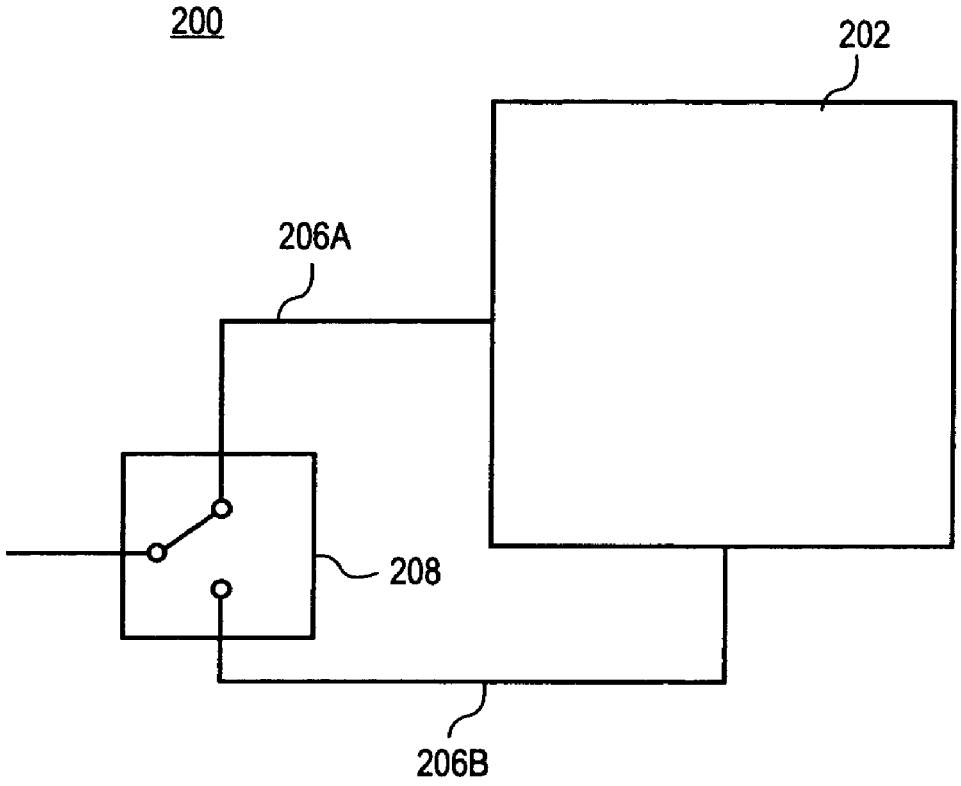
FIGS. 3A and 3B illustrate a patch antenna having strip lines fed at the edge of the patch according to a second embodiment of the invention.
Figure 3B:
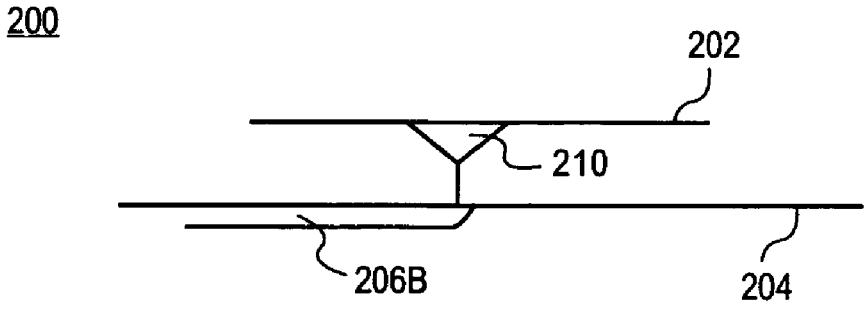

FIGS. 3A and 3B illustrate a patch antenna having strip lines fed at the edge of the patch according to a second embodiment of the invention. FIG. 3A shows an overhead view of a patch antenna 200, and FIG. 3B shows a cross sectional view of the patch antenna 200. The antenna 200 includes a patch 202, a ground plane 204, two strip lines 206*a* and 206*b* and a switch 208. The antenna 200 also includes an impedance matching flare 210, which is coupled to the end of each strip line 206*a* and 206*b*. The impedance matching flare 210 may be modified based on the frequency requirements for the antenna 200. The impedance matching flare 210 is coupled to an edge of the patch 202. The impedance matching flare 210 can be modified by changing its size, location, attachment point, etc. According to an embodiment of the invention, the impedance matching flare 210 has a nominal width of 0.5 inches and nominal height of 0.4375 inches. The width may range from 0.0625 inches to 2 inches, and the height may range from 0.25 inches to 5 inches, depending on the requirements of the specific application.

As mentioned above, the switch 208 may be rapidly alternated to switch between horizontal and vertical polarization. For example, the switch 208 may drive the strip line 206*a* to transmit a vertically polarized signal and drive the strip line 206*b* to transmit a horizontally polarized signal. The switch 208 will only transmit one of a horizontal or vertical signal at a time, thereby driving the full signal strength in one orientation. In this way, each signal is still transmitted at full strength, while the interrogator is able to transmit signals having a different polarization using a single antenna.

Figure 4A:
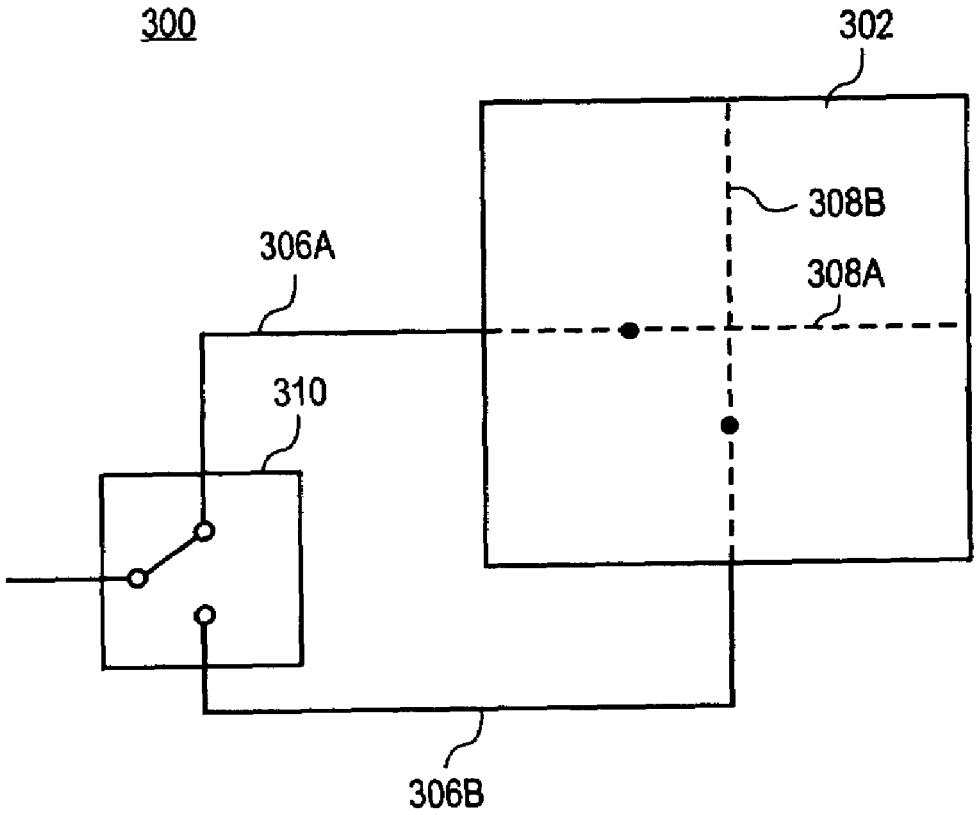
FIGS. 4A and 4B illustrate a patch antenna according to a third embodiment of the invention.
Figure 4B:
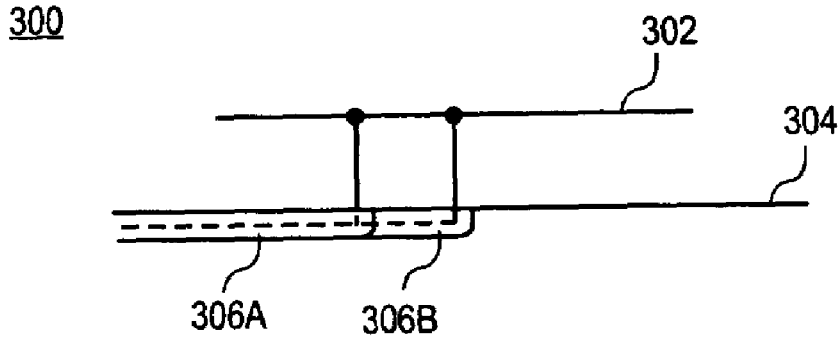

FIGS. 4A and 4B illustrate a patch antenna according to a third embodiment of the invention. FIG. 4A shows an overhead view of a patch antenna 300, and FIG. 4B shows a cross sectional view of the patch antenna 300 according to a third embodiment of the present invention. The patch 302 is located above a ground plane 304. The strip lines 306*a* and 306*b* run through the ground plane 304 and are each connected at a single point to the patch 302. The strip lines 306*a* and 306*b* may be connected to the patch 302 anywhere along the imaginary lines 308*a* and 308*b*. The point of attachment along the lines 308*a* and 308*b* to the patch 302 may be determined based upon the frequency and other characteristics required from the antenna 300. The strip lines 306*a* and 306*b* may connect to the patch 302 through a hole formed in the ground plane 304. Since the characteristics of the transmitted signal are determined by the location of the attachment point of the strip lines 306*a* and 306*b* along the patch 302, a flare, such as the flare 210, is not required with this third embodiment.

The switch 310, like the switches 208 and 112, can rapidly alternate between activating the two strip lines 306*a* and 306*b*. Alternating between the strip lines 306*a* and 306*b* will alternate between transmitted signals having horizontal polarization and signals having vertical polarization. Like mentioned before, this ability allows the antenna 300 to quickly and easily scan items that are typically in a horizontal or vertical position, such as boxes located on a conveyer belt. Implementing this functionality in a single antenna 300 reduces the complexity and cost of the interrogator, as well as reduces the size of the interrogator.

Figure 5A:
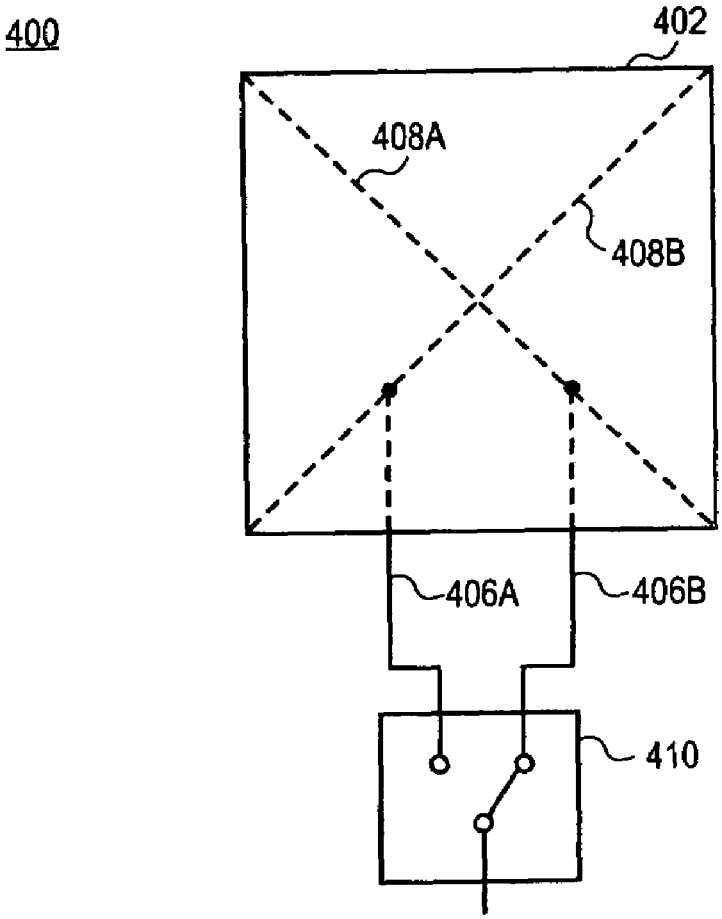
FIGS. 5A and 5B illustrate a patch antenna according to a fourth embodiment of the present invention.
Figure 5B:
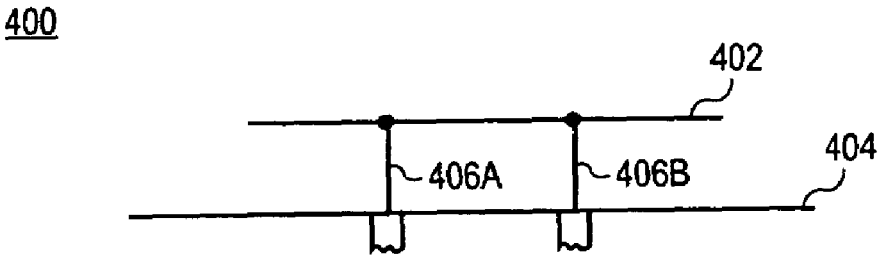

FIGS. 5A and 5B illustrate a patch antenna according to a fourth embodiment of the present invention. FIG. 5A illustrates an overhead view of a patch antenna 400 that has strip lines connected along the diagonals of the patch. FIG. 5B illustrates a cross sectional view of the patch antenna 400. The patch antenna 400 includes a patch 402, a ground plane 404, and two strip lines 406*a* and 406*b*. The strip lines 406*a* and 406*b* are connected with the patch 402 at points located along diagonals 408*a* and 408*b* of the patch 402. As mentioned above with regard to the patch antenna 300, the strip lines 406*a* and 406*b* may be connected to the patch 402 anywhere along the lines 408*a* and 408*b* depending on the frequency and other requirements of the specific interrogator 10 in which the patch antenna 400 will be used. A switch 410 can rapidly alternate between the two strip lines 406*a* and 406*b*, thereby alternating between a vertically and horizontally polarized signal. As mentioned above, this allows the interrogator to quickly read several tags which may have varying horizontal or vertical orientations.

Figure 6:
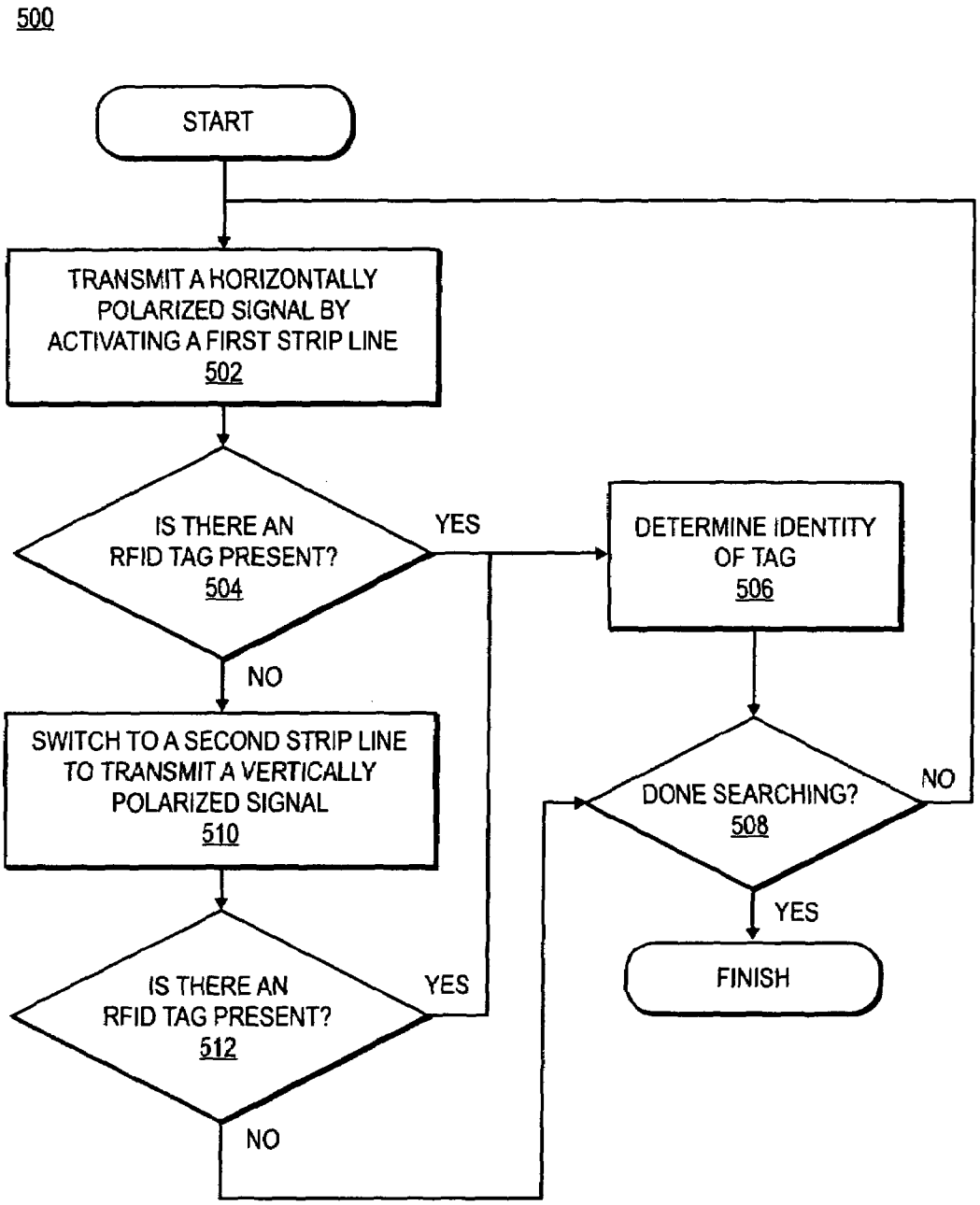
FIG. 6 illustrates a process for determining an identity of an RFID tag according to an embodiment of the present invention.

FIG. 6 illustrates a process for determining an identity of an RFID tag according to an embodiment of the present invention. The process 500 describes using antennas such as those described in FIGS. 1–4 to search for and determine identities of RFID tags located in merchandise or other items. The process 500 may be performed by an interrogator 10 as described above.

The interrogator 10 generally searches for tags by switching between polarizations and detecting whether there are tags present. The interrogator may use any of several different switching profiles, thereby generating signals in a variety of ways. RFID tags often respond to different frequencies, and the interrogator 10 may need to generate signals having varying frequencies to identify all tags. One system the interrogator can use is known as "frequency hopping." Using a frequency hopping switching profile, the interrogator 10 generates a signal at a first frequency, switches a predetermined number of times between horizontal and vertical polarization, identifies any tags that are located, generates another signal at another frequency, etc. This system effectively spends a certain amount of time looking for tags on a specific frequency, and then continues onto the next frequency. Alternatively, the frequency might change at a greater rate than the polarization changes.

Another mode of operation for the interrogator 10 is using an adaptive switching profile. The interrogator 10 could track the number of RFID tags found at each different polarization. The interrogator 10 could then increase the amount of time spent scanning the polarization where the most RFID tags were found, based on the assumption that that more RFID tags are aligned with that polarization. Alternatively, it may be determined that tags aligned with the other polarization are difficult to read, and that more time needs to be spent reading tags aligned with the other polarization.

Finally, the interrogator 10 may use a user-programmed switching profile. The user may choose the switching profile based on a number of factors, including the performance of previously used switching profiles. For example, the user may know that all the RFID tags will be found at only one frequency. The user could then program the interrogator 10 to search only at this frequency.

In block 502, a horizontally polarized signal is transmitted by activating a strip line. As described above, two strip lines may be used on a patch antenna to provide two different directions of polarization. Here, the first strip line will generate a signal having horizontal polarization when it is activated by moving a switch to a position to activate the first strip line. In block 504, it is determined whether an RFID tag is present. Methods for determining whether an RFID tag is present are known in the art, but typically include waiting for a reflected signal, and determining whether the signal has been altered by the RFID tag.

If it is determined that there is an RFID tag present, the identity of the tag is determined in block 506 using well known methods. It is understood that other information besides the identity of the tag may also be transmitted by the tag. In block 508, it is determined whether the interrogator is done searching. For example, the interrogator may only be searching for a single tag, and once the tag is found, the process 500 should be finished. If the interrogator has finished searching, the process 500 ends. If the interrogator is not done searching, the process can return to block 502 and another horizontally polarized signal may be generated, or alternately the process may continue to block 510 where a vertically polarized signal is generated.

If no RFID tag is found in block 504, the process 500 continues to block 510. According to one embodiment, the interrogator may continue to propagate horizontally polarized signals for a predetermined period of time, after which the process will continue in to block 510. In block 510, the position of the switches 112, 208 or etc. has changed to such that a second strip line is activated. The second strip line here will transmit a vertically polarized signal when it is activated. However, it is understood the configuration of the first and second strip line may be reversed. In block 512, it is determined whether there is a RFID tag present. If there is an RFID tag present, the process continues to block 506 where the identity of the tag is determined. If there is no RFID tag found, the process continues to block 508, where it is queried whether the interrogator is done searching. If the interrogator is done searching, the process 500 finishes. If not, the process may return to block 502.

The process 500 is an example of a possible method of determining the identity of RFID tags using a switching patch antenna. It is understood that other processes may also be used. Generally, the alternative processes will include rapidly alternating between horizontally and vertically polarized signals until a tag is found, identifying the tag, and continuing to search for other tags until a predetermined condition is met. The predetermined condition may be a number of tags to be read, an amount of time, or the process may simply continue until the interrogator 10 is manually deactivated. The interrogator 10 may use any one of several different switching profiles, including user-created profiles, adaptive profiles that change the switching based on feedback, etc.

According to another embodiment of the invention, the antennas may also be able to effectively detect tags that are oriented according to a combination of right angles. For example, the interrogator 10 may be able to read a tag that is parallel to the antenna, rather than located horizontally or vertically in relation to the antenna. Also, the two strip lines disclosed may generate polarizations other than horizontal and vertical. For example, a first strip line may generate a linearly polarized signal, while a second strip line generates a linearly polarized signal at a sixty-degree angle to the first signal.

As a further embodiment, the patch antennas may include a third or further strip lines to generate signals having several different orientations. For example, the antennas shown above may include a third strip line that generates a linear polarization at forty-five degrees. Alternatively, the antenna may be configured so that additional elements generate polarizations that comprise elliptical or circular polarizations.

This invention has been described with reference to specific exemplary embodiments thereof. It will, however, be evident to persons having the benefit of this disclosure that various modifications and changes may be made to these embodiments without departing from the broader spirit and scope of the invention. The specification and drawings are accordingly to be regarded in an illustrative, rather than in a restrictive sense.

What is claimed is:

1. An antenna comprising:

a patch element;

a ground plane coupled to the patch element;

a first strip line in the ground plane coupled directly to a first edge of the patch element, the first strip line to propagate a first polarized signal in a first direction when activated;

a second strip line in the ground plane coupled directly to a second edge of the patch element, the second strip line to propagate a second polarized signal in a second direction when activated, wherein the first strip line is activated separately from the second strip line;

a first impedance matching flare coupled between the first edge of the patch element and the first strip line to adjust characteristics of the antenna; and a second impedance matching flare coupled between the second edge of the patch element and the second strip line to adjust characteristics of the antenna.

2. The antenna of claim 1, wherein the ground plane includes an aperture.

3. The antenna of claim 2, wherein the aperture is cross-shaped.

4. The antenna of claim 1, wherein the first direction is horizontal and the second direction is vertical.

5. The antenna of claim 1, wherein the patch element is between 0.5 and 12 inches wide, the ground plane is between 1 inch and 18 inches wide, the first and second strip lines are between 0.03125 inches and 1 inch wide, and wherein the patch element and the ground plane are separated by between 0.25 inches and 5 inches.

6. The antenna of claim 1, wherein the patch element is 4.25 inches wide, the ground plane is 6.5 inches wide, the first and second strip lines are 0.1875 inches wide, and wherein the patch element and the ground plane are separated by 0.5625 inches.

7. The antenna of claim 1, wherein at least one of the first flare or the second flare is between 0.0625 and 2 inches wide, and between 0.25 and 5 inches tall.

8. The antenna of claim 1, wherein at least one of the first flare or the second flare is 0.5 inches wide and 0.4375 inches tall.

9. The antenna of claim 1, further comprising a dielectric material between the patch element and the ground plane.

10. The antenna of claim 1, wherein the second direction is greater than zero degrees and less than ninety degrees from the first direction.

11. The antenna of claim 1, wherein the antenna is configured to read radio frequency identification (RFID) tags.

12. An interrogator comprising:

a transmitter;

a receiver coupled to the transmitter;

a decoder coupled to the receiver to decode received signals; and an antenna coupled to the receiver and the transmitter, the antenna comprising a patch element coupled to a ground plane, a first strip line in the ground plane to propagate a first polarized signal in a first direction, a second strip line in the ground plane to propagate a second polarized signal in a second direction, wherein the first strip line is activated separately from the second strip line, and wherein the first strip line is coupled to a first edge of the patch element and second strip line is coupled to a second edge of the patch element.

13. The interrogator of claim 12, further comprising a first impedance matching flare coupled between the first strip line and the first edge of the patch element, and a second impedance matching flare coupled between the second strip line and the second edge of the patch element.

14. A method comprising:

alternately activating a first strip line on an antenna to propagate a first signal having a first polarization and activating a second strip line on an antenna to propagate a second signal having a second polarization;

searching for an identification tag using the first and second signals; and identifying the identification tag, wherein the second polarization is oriented greater than zero degrees and less than ninety degrees from the first polarization.

15. A method comprising:

alternately activating a first strip line on an antenna to propagate a first signal having a first polarization and activating a second strip line on an antenna to propagate a second signal having a second polarization;

searching for an identification tag using the first and second signals;

identifying the identification tag; and changing a frequency of the first and second signals.

16. The method of claim 15, wherein changing the frequency comprises changing the frequency according to a user-programmed switching profile.

17. The method of claim 15, wherein changing the frequency comprises changing the frequency according to an adaptive switching profile.

* * * * *